United States Patent [19]

Freese et al.

[11] 4,312,411

[45] Jan. 26, 1982

[54] SLIDE RAIL ASSEMBLY FOR A WORK VEHICLE

[75] Inventors: Gary P. Freese, Joliet; Robert J. Trayler, Braidwood, both of Ill.

[73] Assignee: Caterpillar Tractor Co., Peoria, Ill.

[21] Appl. No.: 128,599

[22] Filed: Mar. 10, 1980

Related U.S. Application Data

[63] Continuation-in-part of Ser. No. 973,044, Dec. 12, 1978, abandoned.

[51] Int. Cl.[3] ..... E02F 3/76

[52] U.S. Cl. ..... 172/823; 403/108

[58] Field of Search ..... 172/818, 819, 820, 821, 172/822, 823, 466, 386; 403/108, 328, 324, 316

[56] References Cited

U.S. PATENT DOCUMENTS

| | | | |
|---|---|---|---|
| 2,788,731 | 4/1957 | Lindgren | 172/269 X |
| 3,386,519 | 6/1968 | Long | 172/821 |
| 3,628,612 | 12/1971 | Lies | 172/821 |
| 3,662,838 | 5/1972 | Polzin | 172/823 |
| 3,674,096 | 7/1972 | Berg | 172/821 |
| 3,749,182 | 7/1973 | Rockwell | 172/821 |
| 4,021,126 | 5/1977 | Deeter | 403/322 |
| 4,035,096 | 7/1977 | Miller | 403/322 |
| 4,217,963 | 8/1980 | Freese | 172/818 |

*Primary Examiner*—Richard J. Johnson
*Attorney, Agent, or Firm*—William B. Heming

[57] ABSTRACT

A slide rail assembly (18) and slide plate (20) are used, for example, to position an implement (14) of a work vehicle (10), such as a bulldozer (14), at various angles. The bulldozer connected slide plate (20) moves along a vehicle connected rail (22) of the rail assembly (18) to a desired position of the bulldozer (14). A pin (50) is positioned through openings (48,52) in the rail (22) and slide plate (20) to maintain the position. The pin (50) or rail (22) can sometimes fail owing to working loads exerted on the bulldozer (14). Support members (54) each having pin receiving openings (56) in register with respective rail openings (48) are connected to the rail assembly (18) to increase bearing support area of the pin (50) and to strengthen the rail assembly (18). The support members (54) also each have openings (58) aligned with openings (44,46) in the rail assembly (18) for relief of material packed into the rail (22) and into the pin receiving openings (48,56).

6 Claims, 4 Drawing Figures

SLIDE RAIL ASSEMBLY FOR A WORK VEHICLE

REFERENCE TO RELATED APPLICATIONS

This application is a Continuation-in-Part of application Ser. No. 973,044 filed Dec. 12, 1978, now abandoned, by Gary P. Freese.

DESCRIPTION

1. Technical Field

The invention relates to a slide rail assembly such as is used on a slider mechanism of a work vehicle to position an implement at desired angles relative to the vehicle.

2. Background Art

In the use of a slider mechanism for angling an implement of a work vehicle, it is desirable to prevent damage or failure of the slider mechanism owing to loads exerted on the slider mechanism through the implement.

U.S. Pat. No. 3,662,838 which issued on May 16, 1972, to Polzin et al shows an embodiment of a slider mechanism associated with a C-frame mounted tractor blade. A slide plate or U-shaped base member is positioned about and slides along guide rails and an arm of the C-frame to angle the blade. A pin passes through openings in the slide plate, guide rails and C-frame arm to lock the blade in a desired position. U.S. Pat. No. 3,674,096 which issued to Berg on July 4, 1972 shows a similar embodiment of a power slider mechanism.

U.S. Pat. No. 3,628,612 which issued to Liess on Dec. 21, 1971, shows an embodiment of a slider mechanism associated with a power angling tractor blade. A slide plate or guide member is positioned about and slides along a rail to position the blade. The rail is connected to the C-frame of the blade by a U-shaped leg. U.S. Pat. Nos. 3,386,519 which issued to Long on June 4, 1968, and 3,749,182 which issued to Rockwell on July 31, 1973, show embodiments of slider mechanisms having T-shaped rails about which slide plates are positioned.

For example, a bulldozer of a track-type tractor is generally movable to various angles relative to a longitudinal axis of the vehicle for adjusting the bulldozer to different work operations. In adjusting the bulldozer, a slider mechanism having a slide rail assembly and a slide plate is commonly used. The slide rail assembly is connected to an arm of a C-frame centrally supporting the bulldozer relative to the tractor. The slide plate is connected to an edge of the bulldozer through a positioning arm and moves along the slide rail assembly. Thus, moving the slide plate relative to the slide rail assembly pivots or angles the edge of the bulldozer about its central connection with the C-frame. Tractors generally have two such slider mechanisms associated with opposite arms of the C-frame. The slide plates of each arm move opposite one another relative to the fixed slide rail assemblies when angling the bulldozer.

In one configuration of a slide rail assembly, first and second spaced apart legs are attached to a rail and to an arm of the C-frame. The slide plate slides along the rail to position an opening in the slide plate in register with one of a plurality of openings in the rail to determine a position of the bulldozer. A pin is placed in said openings to secure the bulldozer in the desired position.

Because of high loading on the pin and rail exerted through the slide plate owing to forces on the bulldozer, the pin or rail can deform or fail during operation of the tractor. This represents a waste of time, labor, and material to replace the pin or rail on the tractor. Also, lateral openings in the legs are sometimes positioned adjacent the rail openings to relieve material such as dirt packed between the legs and in the rail openings. These openings can sometimes promote failure of the pin and rail during loading of the bulldozer owing to said openings reducing the structural strength of the slide rail assembly.

Therefore, it is desirable to increase the bearing area provided by the rail openings to support the pins and to strengthen the slide rail assembly in the areas adjacent the rail openings.

DISCLOSURE OF INVENTION

In one aspect of the present invention, a slide rail assembly has a rail and first and second spaced apart legs connected to the rail and defining a continuous channel with said rail between the legs. The rail has a plurality of openings. The legs each have a plurality of relief openings. A plurality of support members each having a pin opening and a relief opening are positioned in the channel. The pin openings are each in register with a respective one of the openings of the rail. The relief openings are each in communication with a respective pair or openings in the first and second legs and with a related one of the pin openings.

The slide rail assembly is used with a slide plate to position, for example, an implement of a work vehicle, such as a bulldozer. The bulldozer connected slide plate moves along the rail to a desired position of the bulldozer. A pin is then positioned in an opening of the slide plate and one of the openings in the rail to maintain the desired position. Failure of the pin or rail can sometimes occur owing to loads exerted on the bulldozer which are passed through the slide plate. The support members structurally strengthen the slide rail assembly. The pin openings in the support members increase being support area for the pins for substantially eliminating pin and rail failure.

BEST MODE FOR CARRYING OUT THE INVENTION

Figure 1:
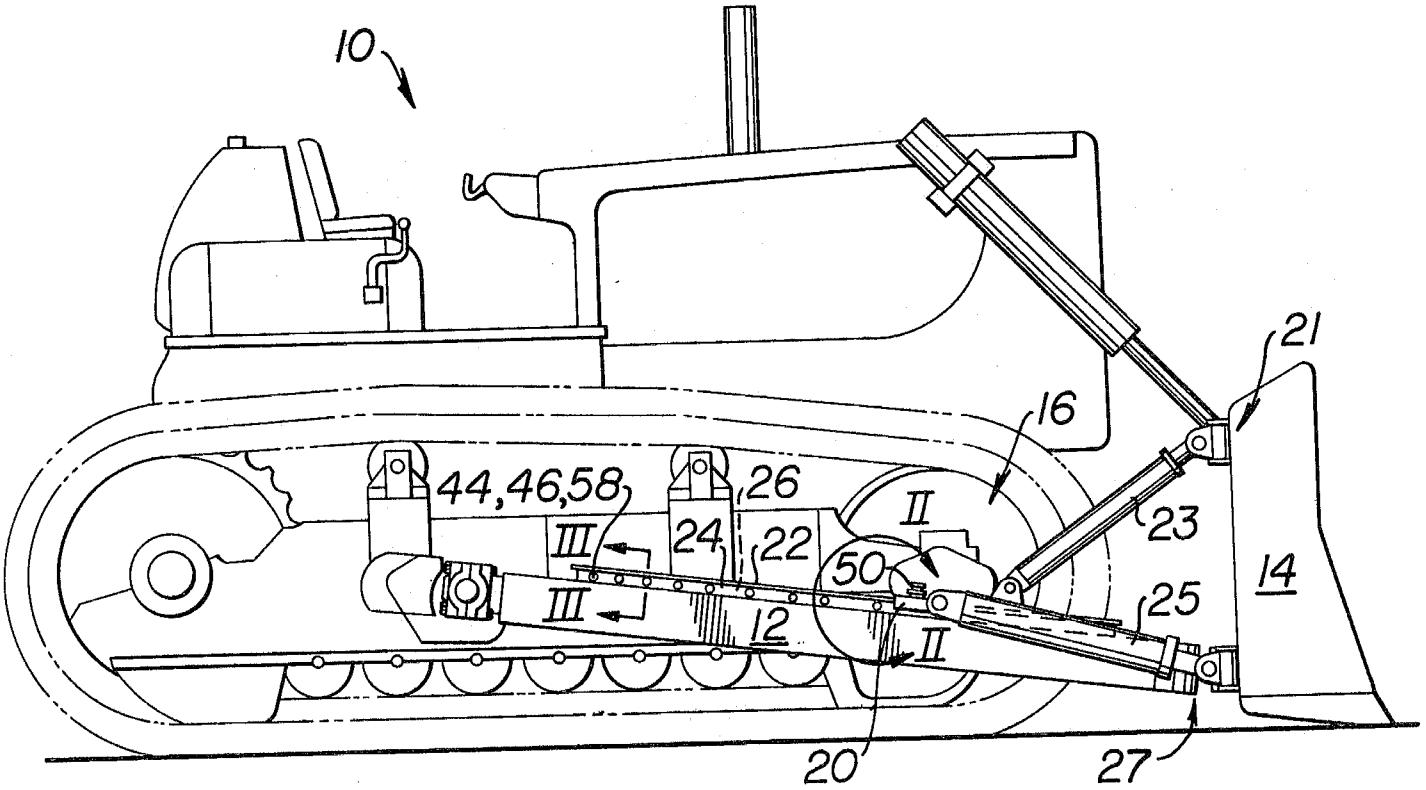
FIG. 1 is a diagrammatic side view of a work vehicle showing one embodiment of the present invention.

Referring particularly to FIG. 1, a work vehicle 10 has a frame 12 and an implement 14. The work vehicle 10 is shown, for example, as a track-type tractor 10 with the frame 12 and implement 14 being a C-frame 12 and bulldozer blade 14, respectively. The C-frame 12 has two arms each of which is pivotally connected to the tractor 10 and associated with a respective slider mechanism. For convenience, only one of the slider mechanisms 16, as is shown, will be discussed. The other slider mechanism is associated with the opposite side of the tractor 10 and is of a similar configuration.

Figure 3:
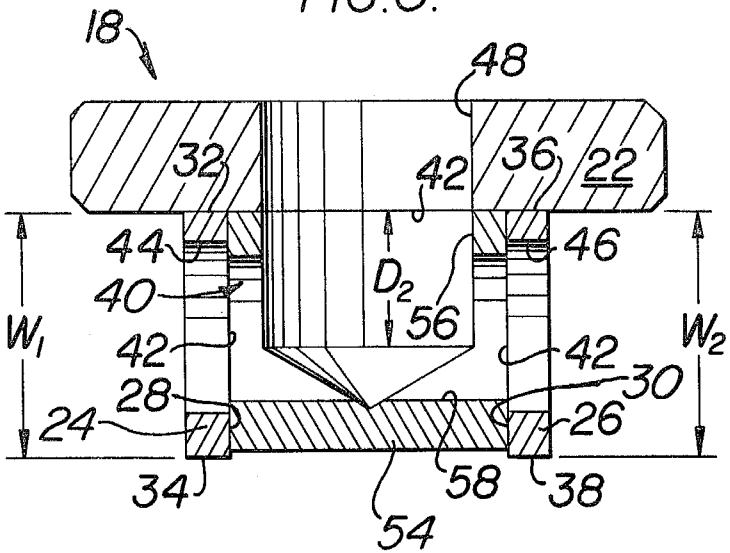
FIG. 3 is a diagrammatic cross-sectional view taken along lines III—III of FIG. 1.
Figure 4:
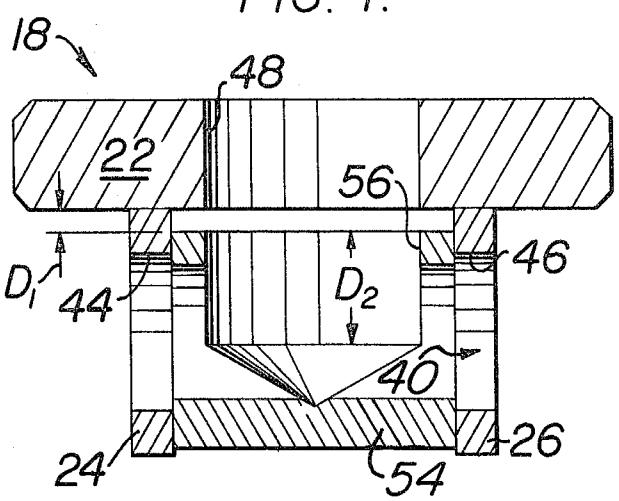
FIG. 4 is a diagrammatic cross-sectional view showing another embodiment of the invention.

The slider mechanism 16 includes a slide rail assembly 18 and a slide plate 20. The slide rail assembly 18 has a rail 22 and first and second spaced apart legs 24,26, as is best seen in FIGS. 3 and 4. Each of the legs 24,26 is connected to and positioned along the rail 22 and is also connected to the arm of the C-frame 12. The slide plate 20 is positioned on and about the rail 22 and is slidably movable relative to said rail 22. The bulldozer blade 14, which is pivotally connected at an end portion 21 to the slide plate 20 by first and second control arms 23,25 and centrally to a forward portion 27 of the C-frame 12, is thus movable to preselected positions at different angles relative to the tractor 10 in response to slidably moving the slide plate 20 relative to the rail 22 and C-frame 12.

The legs 24,26 of the slide rail assembly 18 each have an inner surface 28,30 and first and second ends 32,34;36,38 (FIG. 3). Said legs 24,26 are connected at the first ends 32,36 to the rail 22 and define a continuous channel 40 with said rail 22 and the frame 12 between said legs 24,26. The inner surfaces 28,30 each define a respective portion of the periphery 42 of said channel 40 and each have a width $W_1$,$W_2$ defined by said respective inner surfaces 28,30 normal to the rail 22. In other words, each of the widths $W_1$,$W_2$ extends from the first ends 32,36 to the second ends 34,38 of the respective inner surfaces 28,30 at right angles to the rail 22.

Figure 2:
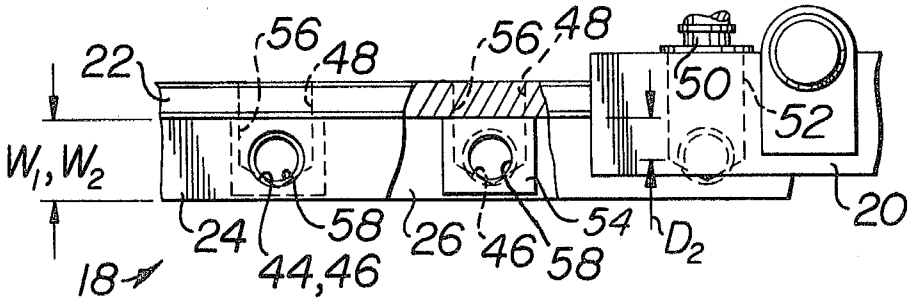
FIG. 2 is a diagrammatic partial view taken along line II—II of FIG. 1.

The legs 24,26 also each have a plurality of relief openings 44,46. Said openings 44,46 can be, for example, positioned in the legs 24,26 as shown or defined by individual spaced apart segments of the legs 24,26. The rail 22 has a plurality of openings 48 passing through said rail 22 and into communication with the continuous channel 40. The openings 44 of the first leg 32 are each positioned adjacent a respective one of said openings 48 of the rail 22. Said openings 44 of the first leg 32 are each generally in alignment with a respective one of the openings 46 of the second leg 34 across the channel 40. The openings 48 of the rail 22 are of a size sufficient for receiving a pin 50 (FIGS. 1 and 2) which is removably positionable in an opening 52 of the slide plate 20 and the rail openings 48 in response to moving the slide plate 20 along the rail 22. Such implement 14 and slide plate 20 operation is well known in the earthmoving art and is commonly used to provide both manual and power angling of a tractor implement.

In the slide rail assembly 18, a plurality of support members 54 are positioned in the channel 40 and connected to said slide rail assembly 18. The support members 54 each have a pin opening 56 and a relief opening 58. The pin openings 56 are each in register with a respective one of the openings 48 of the rail 22 for receiving a portion of the pin 50 when is it positioned in the related one of the openings 48 in the rail 22 and the opening 52 of the slide plate 20. The relief openings 58 are each in communication with a respective pair of aligned openings 44,46 in the first and second legs 24,26. Said relief openings 58 are also each in communication with a respective related one of the pin openings 56 in order to provide relief of packed material from the pin openings 56 through the openings 44,46 in the legs 24,26 and away from the slider mechanism 16. The relief openings 58 are shown aligned with the respective openings 44,46 in the legs 24,26 to maximize passage of packed material through the openings 58,44,46.

In the preferred embodiment, the support members 54 are connected to and extend between the first and second legs 24,26. The support members 54 are shown represented by individual blocks connected to the slide rail assembly 18 adjacent the openings in the rail 22. The support members 54 preferably extend and are connected by welding or the like to the legs 24,26 substantially along the widths $W_1$,$W_2$ of the inner surfaces 28,30 of said legs 24,26. The support members 54 also preferably are each positioned in contact with and connected to the rail 22 (FIG. 3). As is shown in FIG. 4, the support members 54 can also be positioned at a preselected distance $D_1$, from the rail 22.

It should be understood that the slider mechanism 16 can be of other configurations as is known in the art without departing from the invention.

INDUSTRIAL APPLICABILITY

In the use of the slide rail assembly 18, the slide plate 20 is moved along the rail 22 to position the bulldozer blade 14 at a desired angle relative to the tractor 10. The pin 50 is inserted into the opening 52 in the slide plate 20 and openings 48,56 of the rail 22 and its related support member 54 in register with the slide plate opening 52 to secure the bulldozer blade 14 in the desired position.

The additional distance $D_2$ (FIGS. 3 and 4) which the pin 50 extends into the pin openings 56 in the support members 54 represents a proportionate increase in the bearing area of the slide rail assembly 18 relative to the pin 50. The extra bearing area relative to that of the bearing area of the rail openings 48 provides increased resistance of the pin 50 to axial loads applied on said pin 50 from the bulldozer blade 14 through the slide plate 20 and rail 22. The result is to substantially maintain the pin 50 against bending. The support members 54 reinforce the portions of the slide rail assembly 18 adjacent the rail openings 48 to substantially maintain the rail 22 from yielding under work loads on the bulldozer blade 14. Bushings can also be positioned in related openings 48 in the rail and pin openings 56 in the support members 54 to provide a replaceable bearing surface. Also, the bushings can be sized to extend through the pin openings 56 into the passageways defined by the relief openings 58 to increase the bearing area available to support the pin 50, which will most generally be of sufficient length to extend downwardly about halfway through such passageways.

It is desirable that the support members 54 have a material hardness greater than the material hardness of the legs 24,26 for further strengthening the pin bearing area and the portions of the slide rail assembly 18 adjacent said rail openings 48. The configuration of the present invention permits, for example, support members 60 which are heat treated separately from the rail 22 and legs 24,26 to be assembled on the slide rail assembly 18. The result is an increased tendency of the pin 50 and rail 22 to resist yielding under the tractor work loads.

Further, the support members 54 extend between the first and second legs 24,26 at a location sufficient for blocking a flow of material, such as mud or the like, into the continuous channel 40 through the related one of the respective pairs of aligned openings 44,46 adjacent which each is positioned. Thus, foreign matter encountered during operation of the tractor 10 is prevented from packing in the internal channel 40 of the slide rail assembly 18. Instead, any packing of material takes place in the relief openings 58 and associated leg openings 44,46 which can easily be cleared of the packed material.

Other aspects, objects and advantages will become apparent from a study of the specification, drawings and appended claims.

We claim:

1. In a slide rail assembly (18) having a rail (22) and first and second spaced apart legs (24,26), said legs (24,26) each having a plurality of openings (44,46) and each being connected to and positioned along said rail (22) and defining a continuous channel (40) with said rail (22) between said legs (24,26), said rail (22) having a plurality of openings (48) passing through said rail (22) and into communication with said channel (40), said openings (44) of said first leg (24) each being generally in alignment with a respective one of said openings (46) of said second leg (26) across said channel (40) and each being positioned adjacent a respective one of said openings (48) of said rail (22), the improvement comprising:

a plurality of support members (54) each having a pin opening (56) and a relief opening (58) and each being positioned in said continuous channel (40) and extending between said first and second legs (24,26) at a location sufficient for blocking flow of material into said channel (40) through a respective pair of aligned openings (44,46) in said first and second legs (24,26), said pin openings (56) each being in register with a respective one of the openings (48) of the rail (22), said relief openings (58) each being in communication with the related one of said respective pair of aligned openings (44,46) in said first and second legs (24,26) and with a respective related one of the pin openings (56).

2. The slide rail assembly (18), as set forth in claim 1, wherein said support members (54) have a material hardness greater than material hardness of the legs (24,26).

3. The slide rail assembly (18), as set forth in claim 1, wherein each of said legs (24,26) has an inner surface (28,30) each having a width $W_1$,$W_2$ defined by said respective inner surface (28,30) normal to the rail (22) and defining a respective portion of the periphery of the channel (40) and the support members (54) extend substantially along the widths ($W_1$,$W_2$) of said inner surfaces (28,30).

4. The slide rail assembly (18), as set forth in claim 1, wherein said support members (54) are positioned in contact with said rail (22).

5. The slide rail assembly (18), as set forth in claim 1, wherein said support members (54) are positioned at a preselected distance $D_1$ from said rail (22).

6. A slider mechanism (16) for an implement (14) movably connected to a frame (12) of a work vehicle (10), comprising:

first and second spaced apart legs (24,26) each defining a plurality of openings (44;46) and each being connected to and positioned along said frame (12), said openings (44) of said first leg (24) each being generally in alignment with a respective one of said openings (46) of said second leg (26);

a rail (22) having a plurality of openings (48) and being connected to both of said first and second legs (24,26) and defining a continuous channel (40) with said frame (12) between said spaced apart first and second legs (24,26), said openings (48) of said rail (22) passing through said rail (22) into communication with said channel (40) and each being positioned adjacent a respective one of said aligned openings (44;46) in said first and second legs (24,26);

a plurality of support members (54) each having a pin opening (56) and a relief opening (58) and each being positioned in said continuous channel (40) and extending between said first and second legs (24,26) at a location sufficient for blocking flow of material externally of said rail (22) and said first and second legs (24,26) into said continuous channel (40) through a respective pair of aligned openings (44,46) in said first and second legs (24,26), said pin openings (56) each being in register with a respective one of the openings (48) of said rail (22), said relief openings (58) each being in communication with the related one of said respective pairs of aligned openings (44,46) in said first and second leg (24,26) and with a related one of said pin openings (56); and a slide plate (20) having a pin (50) and an opening (52) and being positioned on and about said rail (22) and movable relative to said rail (22), said pin (50) being positionable through said opening (52) of said slide plate (20) into said openings (48) in said rail (22) and said related respective pin openings (56) in said support members (54) in response to moving said slide plate (20) along said rail (22).

* * * * *